US005653485A

United States Patent [19]

Campbell

[11] Patent Number: 5,653,485

[45] Date of Patent: Aug. 5, 1997

[54] SINGLE ACTUATION SASH LOCK

[75] Inventor: Frank W. Campbell, Oakdale, Minn.

[73] Assignee: Andersen Corporation, Bayport, Minn.

[21] Appl. No.: 410,923

[22] Filed: Mar. 27, 1995

[51] Int. Cl.[6] ..... E05C 3/04

[52] U.S. Cl. ..... 292/241; 292/240; 292/207; 292/DIG. 20

[58] Field of Search ..... 292/241, 240, 292/100, 200, 197, DIG. 20, DIG. 35, DIG. 47, 207

[56] References Cited

U.S. PATENT DOCUMENTS

| | | | |
|---|---|---|---|
| 1,794,171 | 2/1931 | Grutel | 292/207 X |
| 3,055,996 | 9/1962 | Beebe et al. | 292/241 |
| 3,600,019 | 8/1971 | Toyota et al. | 292/207 X |
| 3,785,684 | 1/1974 | Nakanishi | 292/207 X |
| 4,095,829 | 6/1978 | Van Klompenburg | 292/241 |
| 4,253,688 | 3/1981 | Hosooka | 292/52 |
| 4,610,472 | 9/1986 | Billingsley | 292/54 |
| 4,826,222 | 5/1989 | Davis | 292/DIG. 38 X |
| 4,896,905 | 1/1990 | Lehr et al. | 292/241 X |
| 5,087,087 | 2/1992 | Vetter et al. | 292/48 |
| 5,172,944 | 12/1992 | Munich et al. | 292/240 X |

FOREIGN PATENT DOCUMENTS

| | | | |
|---|---|---|---|
| 2026594 | 2/1980 | United Kingdom | 292/DIG. 47 |

*Primary Examiner*—Rodney M. Lindsey
*Assistant Examiner*—Monica E. Millner
*Attorney, Agent, or Firm*—Merchant, Gould, Smith, Edell, Welter & Schmidt, P.A.

[57] ABSTRACT

An improved single actuation casement and awning window securing mechanism comprising two cams and a linking arm held in tension upon closing. The cams operate in unison in a clamshell fashion, such that closing and opening of the single actuation sash lock is accomplished in an easy and secure manner.

2 Claims, 4 Drawing Sheets

FIG. 1
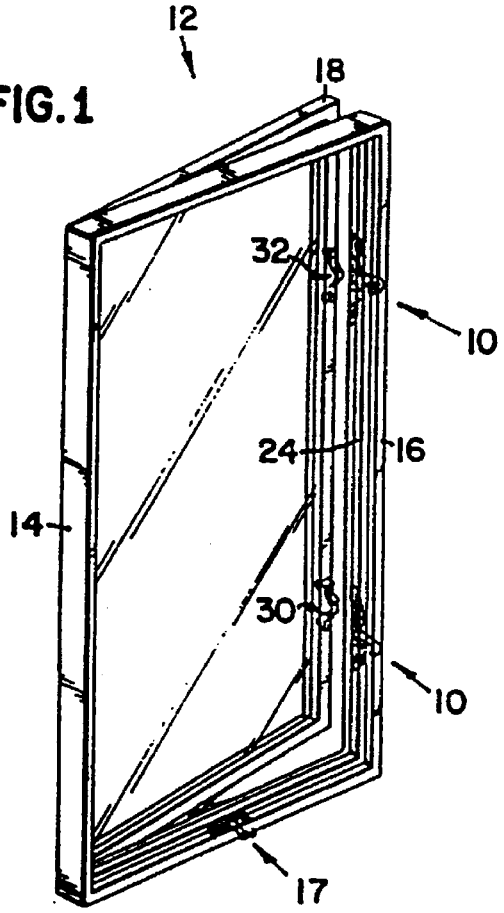
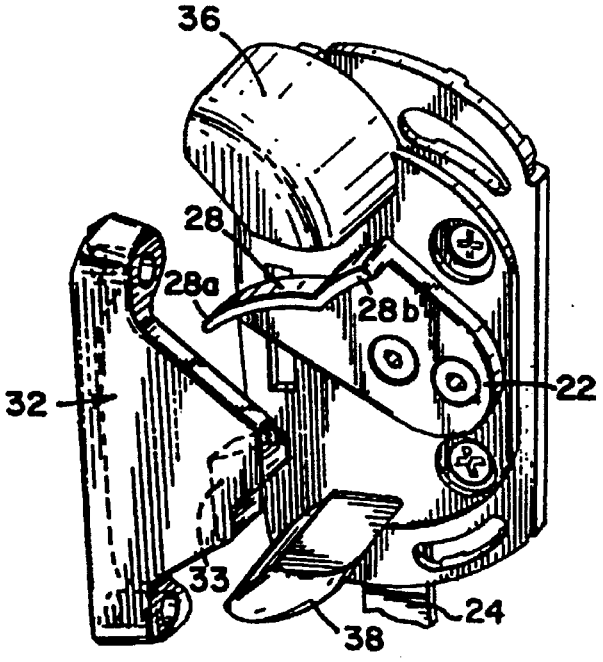
FIG. 5

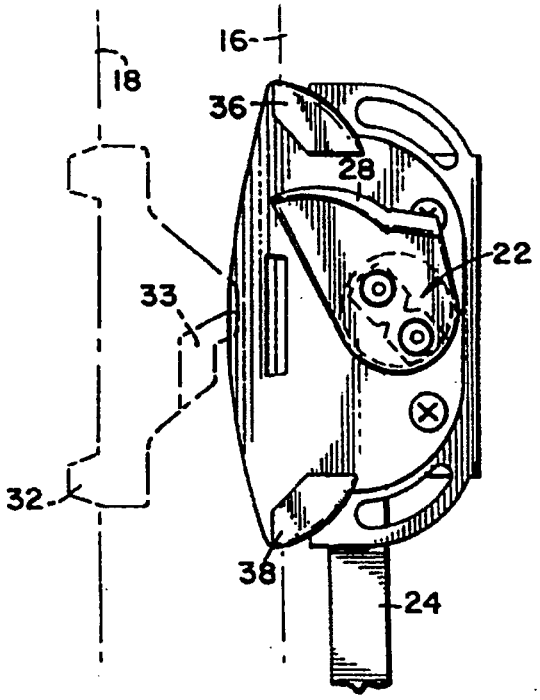
FIG. 3
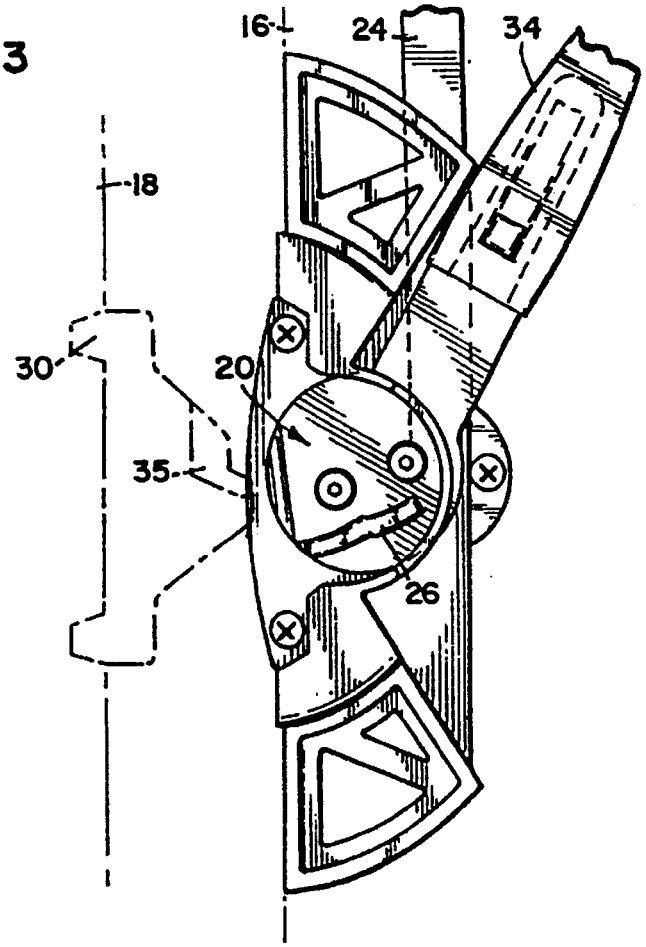

SINGLE ACTUATION SASH LOCK

FIELD OF INVENTION

This invention relates to an improved single actuation lock to secure a sash to a window frame. The lock is useful for casement and awning style windows.

BACKGROUND OF THE INVENTION

Sash locks for casement and awning windows are well known. Casement and awning windows are generally defined as having a glass panel, with each panel in a sash, with the sash moveable within a frame which is secured in the dwelling in which the window resides. The sash is mounted in a window frame, defined by jamb liners on the sides, a head jamb on the top and a sill on the bottom. Typically, the sash is secured to the frame and is hinged to the frame through a window operator having hinges.

Typically, for large casement and awning style windows, a single point sash lock is insufficient to adequately secure the full length of the sash in place. If a single point sash lock is used for casement windows which are typically larger than two to three feet as measured on one side, the corners of the sash may not be tightly secured in the frame of the window. Thus, the two point lock system is desirable for larger windows.

U.S. Pat. No. 4,095,829 discloses a two point lock system for locking windows. Among other things, the patent is directed to a lost motion mechanism which results in one engaging cam rotating earlier than a second engaging cam. This lost motion is achieved by a pin and slot configuration whereby a pin moves through a slot, but does not move the cam initially.

U.S. Pat. No. 5,087,087 discloses a casement sash lock. This patent is directed to a catch operator being secured in a housing, such that it is not extending outward in an exposed position.

U.S. Pat. No. 4,610,472 discloses a casement window securing mechanism which utilizes a double cam system whereby rotation of the second cam occurs in response to rotation of the first cam. The second cam draws a catch at a rate varying with the cam angle of rotation. U.S. Pat. No. 4,253,688 discloses yet another type of sash lock.

The prior designs for sash locks suffer from a number of drawbacks. One drawback is often times the cam engagement mechanisms are complex, involving moving parts, and do not adequately center the sash within the frame and enclosed position.

Another problem associated with prior sash locks are the connecting bar between the engaging cams was pushed rather than pulled when closing the sash. The pushing action results in flexing of the connecting rod, which creates an inefficient mechanism for moving the connected cam to lock the sash in place.

SUMMARY OF THE INVENTION

The present invention relates to an improved single actuation lock. The lock comprises a unique clam shell securing mechanism whereby the cams both rotate inwardly, both securing the sash in place and self-centering the sash. The cams and the keepers of the present invention have no moving parts and can be molded from an engineering polymer, which prevents the need to plate or provide a finish to these parts. If a plating or finish is used, the plating or finish rubs off during use, resulting in aesthetically unpleasing window hardware.

The present invention, comprises:

(a) at least two rotatable cams, each of the cams secured to a jamb member of the window;

(b) each rotatable cam engageable with a keeper on the sash, the rotatable cams being rotatable in a closing direction which secures the keeper in a closed mode and substantially immobilizes the sash, the cam thereafter being rotatable in an opening direction which releases the cam from the keeper such that the sash may be opened, the rotation of the cams occurring such that the lower cam rotates in a clockwise direction upon closing and the upper cam rotates in a counter-clockwise position upon closing, with the rotations being opposite upon opening the sash lock;

(c) a linking bar mechanically secured to the cams, with the linking bar in tension upon rotating the cams in closing direction.

These and other advantages are apparent in reviewing the specification, drawings and claims herein.

DETAILED DESCRIPTION OF THE DRAWINGS

FIG. 1 is a perspective view of the lock of the present invention secured to a side jamb member of a window.

FIG. 3 is a schematic drawing of the single actuation lock of the present invention in a fully open position.

FIG. 5 is a closeup perspective view of the upper portion of the single actuation lock.

DETAILED DESCRIPTION OF THE INVENTION

Figure 2:
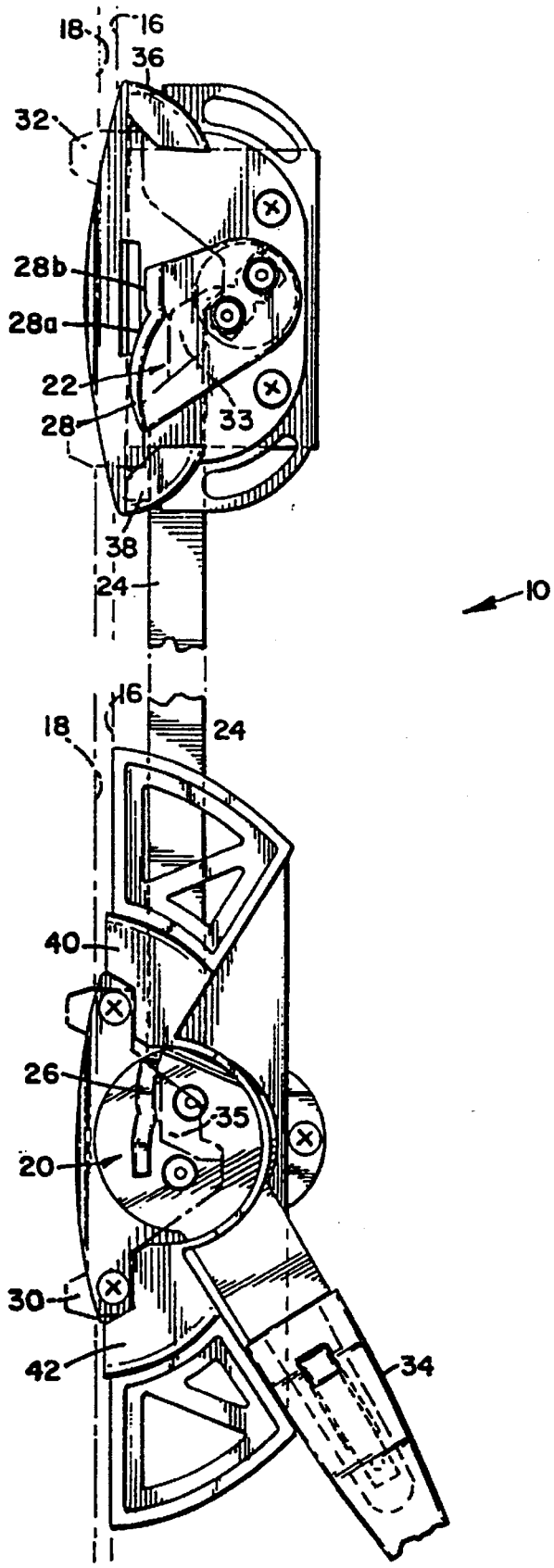
FIG. 2 is a schematic drawing of the single actuation lock of the present invention in a fully closed position.

FIG. 1 is a general perspective view of the sash lock 10 of present invention secured within a window 12 which is open. The window 10 has side jamb members 14 and 16. Lock 10 is secured to jamb member 16. When window 12 is to be closed, a window operator 17 is generally rotated which moves an outer portion of sash 18 in a direction toward side jamb member 16. When sash 18 has been moved in position to be locked in place, lock 10 is engaged. Thereafter, when it is desired to open window 12, lock 10 is disengaged, and the window operator 17 is rotated such that sash 18 is swung open.

As can be seen from FIG. 1, sash lock 10 has two points of engagement for the sash lock assembly 10 to engage sash 18. This two point system is the preferred number of points, however there can be more than two points of engagements, such as for larger windows, or windows which need the additional security.

FIG. 2 illustrates the sash lock 10 of the present invention in a closed mode. Sash lock 10 has cams 20 and 22. Cams 20 and 22 are mechanically connected through linkage arm 24. Cams 20 and 22 have keeper engagement means 26 and 28 respectively. The sash keeps 30 and 32 are shown in phantom, which are engaged by means for engagements 26 and 28 respectively.

Figure 4:
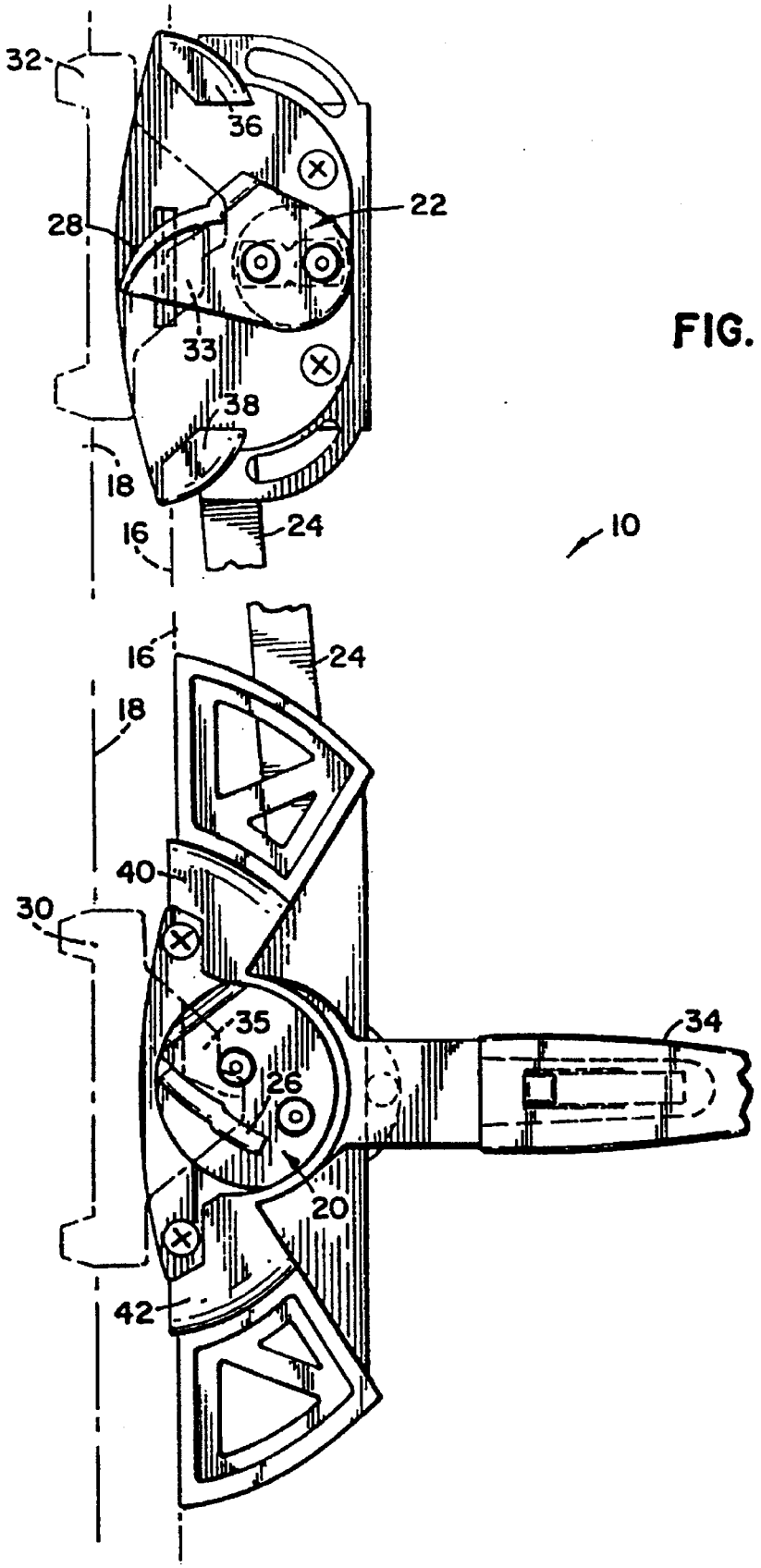
FIG. 4 is a schematic drawing of the single actuation lock of the present invention in a position approximately half way between a fully open and a fully closed position.

Focusing on the upper cam, 22, extension arm 24 is secured to cam 22 via some form of mechanical connecting means (not shown). This can be a fastener, a weld, a pin/hole arrangement or other type of means for fastening. Cam 22 has a raised rim 28 which engages a keeper on a sash of a window. The rim 28 has, preferably, two arcuate surfaces 28*a* and 28*b*. When sash lock 10 is moved from an open position to a closed position (FIG. 3 and FIG. 4 show an open and partially open position respectively), cam 28 is rotated in a counterclockwise direction. During rotation, cam surface 28*a* first engages sash keep 32, whereby keep 32 follows along surface 28*a* until it is engaged by surface 28*b*. Surface 28*b* is the surface which securely engages keep 32 when sash lock 10 is in the locked position. The preferred embodiment has two cam surfaces, but more cam surfaces or just one cam surface can be used, depending on the configuration of the sash keeper.

One of the key features of the present invention is cam 22, when being rotated to a locking position, rotates in a counterclockwise position, whereby the lower cam 20, as described in more detail below, rotates in a clockwise direction upon closing. Thus, the cams 22 and 20, acting in unison, close upon the sash keepers 32 and 30 in a clamshell fashion. This advantageous action results in a surprisingly tight sash engaging action. During the entire engagement of the sash 18, linkage arm 24 remains in tension, as a result of cam 22 being rotated in a counterclockwise fashion. It is preferred to have linkage arm 24 be pulled and in tension, rather than being pushed during the sash engagement, due to unwanted flexing of linkage arm 24 occurring if it is pushed during the sash engagement. Typically, a linkage arm connecting two cams is located in a routed portion of a side jamb. If a linkage arm is pushed to rotate an upper cam into a sash engaging position, all of the force applied to the linkage arm is not transferred to rotating the cam, but rather some of the force is lost in flexing of the linkage arm. Thus, a pulling of the linkage arm is preferred.

The same concepts are applied to the cams 22 and 20, rotating in a clam shell fashion. Both upper and lower cams 22 and 20, upon being engaged to close sash 18, are pulled, being rotated counterclockwise and clockwise, respectively to a closed position. Thus, upon closing and locking the sash, both cams 20 and 22 and the linkage arm 24 are being utilized in an effective manner such that the force applied by the user to handle 34 is not lost through pushing of the cams and/or linkage arm.

Another advantage of the clamshell closure of the cams is self centering of the sash can easily occur.

Handle 34 is preferably attached to lower cam 20 through some mechanical fastening means. This can be a fastener, a weld, a pin/hole arrangement or other type of means for fastening. The end of handle 34 which is not connected to cam 20 is fitted with an aesthetically appealing handle.

FIG. 3 illustrates the sash lock 10 in an open position. This position occurs when the sash is not closed. Cams 20 and 22 are in an open clamshell mode, and have not engaged keepers 30 and 32, which are again shown in phantom. To achieve the closed mode shown in FIG. 2, handle 34 is brought down, thereby rotating cams 20 and 22 to engage keepers 30 and 32 respectively.

FIG. 4 illustrates the sash lock 10 of the present invention in approximately in a half open, half closed mode. Handle 34 is pulled approximately half way down, which rotates cams 20 and 22 approximately half way. Rims 26 and 28 have partially engaged keepers 30 and 32. As can be seen, rim 22 reaches keeper 32 before cam 20 reaches keeper 30. This is the preferred mode of operation for the present invention in that the sash is pulled into place, ready to be engaged by the lower cam 20, and thereafter locked.

FIG. 5 discloses a perspective view of the upper cam 22 and keeper 32 arrangement of the present invention. As can be seen from FIG. 5, cam 22 engages keeper 32, wherein the surface of engagement is shown in phantom as 33. The raised portions 28 of the cam 22 engage the phantom ridge 33 of sash keep 32. As can be seen, 33, in FIG. 5 is a projection extending approximately perpendicular from the face of sash keeper 32. This is a typical configuration for a sash keeper, and although it is disclosed as a preferred mode, any means for sash engagement could be utilized.

Also, in FIG. 5, are sash keeper guides 36 and 38. These guides help keep the sash keep 32 in place. Similar guides are visible in FIG. 2 on the lower unit as 40 and 42. These sash keeper guides can be configured in a manner to match the sash keeper, such as to minimize movement in the vertical direction of the sash with regard to the frame.

Although the present invention has been described with reference to preferred embodiments, workers skilled in the art will recognize that changes may be made in form and detail without departing from the spirit and scope of the invention.

We claim:

1. A sash lock for a window having a moveable sash, said sash lock comprising:

a. a first and a second keeper;

b. a first cam having a first and a second surface wherein rotation of said first cam in a closing direction engages said first surface with said first keeper and wherein further rotation of said first cam locks said second surface to said first keeper;

c. a second cam having a third and a fourth surface wherein rotation of said second cam in a closing direction engages said third surface with said second keeper and wherein further rotation of said second cam locks said fourth surface to said second keeper;

d. a linking bar having a body for routing through said moveable sash and a first and a second end wherein said first end mechanically connects to said first cam and wherein said second end mechanically connects to said second cam so that rotation of said first cam in one direction rotates said second cam in the opposite direction;

e. a handle mechanically connected to said first cam;

f. a first sash keeper guide wherein said first sash keeper guide matches said first sash keeper for aligning said moveable sash; and g. a second sash keeper guide wherein said second sash keeper guide matches said second sash keeper for aligning said moveable sash.

2. A sash lock for a window having a moveable sash, said sash lock comprising:

a. a first and a second keeper;

b. a first cam having a first and a second surface wherein rotation of said first cam in a closing direction engages said first surface with said first keeper and wherein further rotation of said first cam locks said second surface to said first keeper;

c. a second cam having a third and a fourth surface wherein rotation of said second cam in a closing direction engages said third surface with said second keeper and wherein further rotation of said second cam locks said fourth surface to said second keeper;

d. a linking bar having a body for routing through said moveable sash and a first and a second end wherein said first end mechanically connects to said first cam and wherein said second end mechanically connects to said second cam so that rotation of said first cam in one direction rotates said second cam in the opposite direction; and e. a handle mechanically connected to said first cam.

* * * * *